US005126191A

United States Patent [19]

Fourezon

[11] Patent Number: 5,126,191

[45] Date of Patent: Jun. 30, 1992

[54] PROCESS FOR THE PRODUCTION OF A TEXTILE REINFORCING WEB FOR COMPOSITE MATERIALS BASED ON RESINS AND NEW TYPE OF WEB

[75] Inventor: André Fourezon, Le Cheylard, France

[73] Assignee: Establissements les Eils D'Auguste Chomarat et Cie, France

[21] Appl. No.: 628,481

[22] Filed: Dec. 14, 1990

[30] Foreign Application Priority Data

Dec. 22, 1989 [FR] France ..... 89 17394

[51] Int. Cl.[5] ..... D04B 1/00; D06C 11/00

[52] U.S. Cl. ..... 428/229; 428/91; 428/96; 428/265; 428/268; 26/28

[58] Field of Search ..... 26/28; 264/162; 139/420 C, 383 R, 420 A; 428/290, 236, 229, 265, 268, 91, 96

[56] References Cited

U.S. PATENT DOCUMENTS

| | | | |
|---|---|---|---|
| 2,617,170 | 11/1952 | Mulholland | 26/28 |
| 2,887,132 | 5/1959 | Manning et al. | 139/420 C |
| 3,669,158 | 6/1972 | Phillips | 139/420 C |
| 3,787,224 | 1/1974 | Uffner | 139/420 C |
| 3,894,318 | 7/1975 | Ito et al. | 26/28 |
| 4,316,928 | 2/1982 | Otto | 26/28 |
| 4,480,362 | 11/1984 | Maxwell | 26/28 |
| 4,512,065 | 4/1985 | Otto | 26/28 |

FOREIGN PATENT DOCUMENTS

| | | |
|---|---|---|
| 0291026 | 5/1987 | European Pat. Off. . |
| 2145263 | 12/1973 | France . |
| 2255405 | 12/1973 | France . |
| 2335636 | 12/1975 | France . |
| 2525644 | 6/1982 | France . |

*Primary Examiner*—Werner H. Schroeder
*Assistant Examiner*—Amy Brooke Vanatta
*Attorney, Agent, or Firm*—Wall and Roehrig

[57] ABSTRACT

Treated fabric is described that exhibits good bond characteristics when embedded in a resin binder making it possible to obtain a laminated plaque having a finished uniform surface quality.

6 Claims, 1 Drawing Sheet

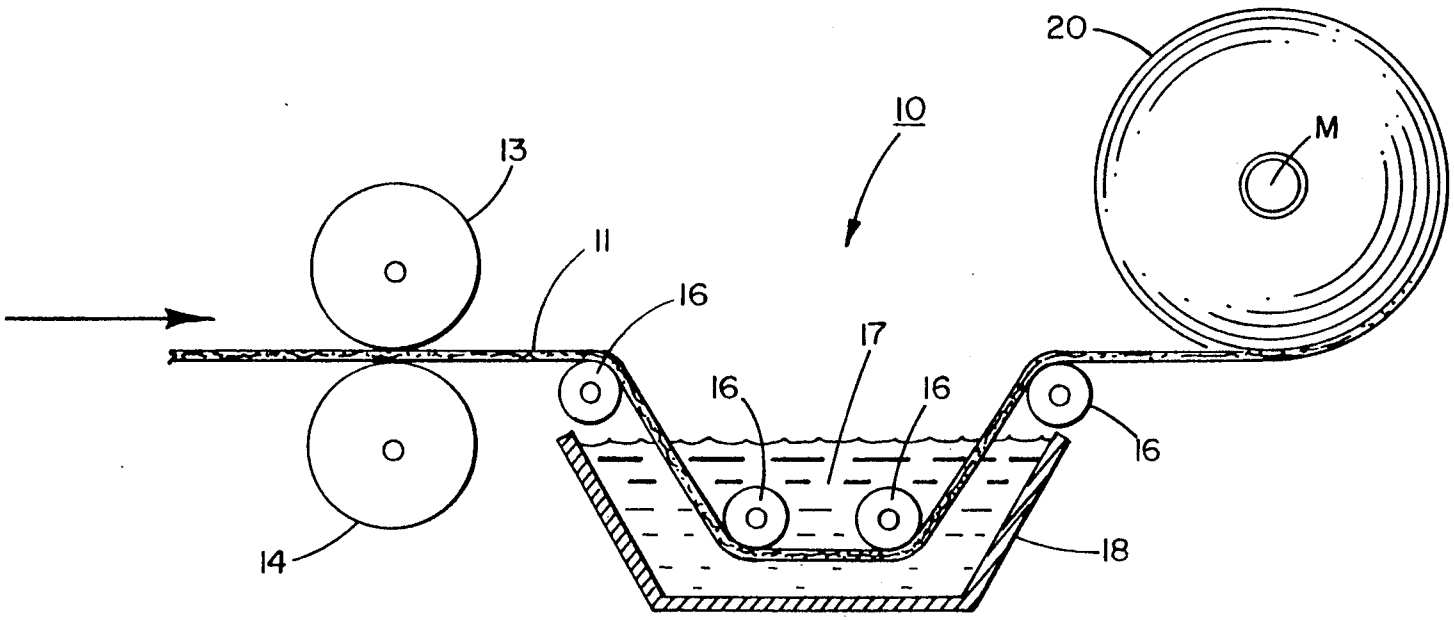
10
11
13
14
16
16
16
16
17
18
20
M

PROCESS FOR THE PRODUCTION OF A TEXTILE REINFORCING WEB FOR COMPOSITE MATERIALS BASED ON RESINS AND NEW TYPE OF WEB

Background of the Invention

The present invention relates to a process making it possible to produce a textile reinforcing web capable of being employed for the production of composite materials, that is to say resin-based materials.

Composite materials consisting of a resin reinforced with a textile web such as a fabric, knit or non-woven have been known for a very long time. In addition to the needled nonwovens, especially those based on glass fibres, it has also been proposed to employ as a reinforcing web woven structures which make it possible to obtain better mechanical characteristics in the lengthwise and transverse directions. However, the problem which arises with such woven structures, especially when they are based on continuous glass yarns (Silionne), is that of having good bonding between the resin and the structure, especially to avoid any delamination phenomena in use.

One of the methods commonly employed to obtain such a bonding consists in needling the textile structure, which has, however, the disadvantage of resulting in a deterioration in the mechanical characteristics of the textile support, especially when it is woven.

Another commonly employed solution consists in combining the fabric with a fibrous voile bonded to the said fabric by adhesive bonding or needling. Such a composite yields good results but complicates the manufacturing process because it involves having two types of different substances (fabric and nonwoven), which necessarily entails problems of immobilisation and hence of increasing manufacturing costs. Furthermore, the operation of bonding between the fibrous voile and the support fabric is relatively tricky to carry out and, above all, when used, it can happen that the fibrous surface results in a nonuniform surface appearance in the finished composite material, requiring a subsequent rubbing-down treatment.

There has now been found, and this is what forms the subject of the present invention, a process which is simple and economical to use, which makes it possible to produce a reinforcing web based on a warp-and-weft fabric, consisting especially of continuous glass filaments (or any other type of continuous filaments employed for the production of composite articles, such as carbon filaments, aramid, etc), solving these problems, and which entails very good bonding between the resin and said textile support and the production of a finished product which has a surface appearance which is practically free from any fault, requiring no additional finishing treatment, such as rubbing down, etc.

Brief Description of the Drawing

For a better understanding of the present invention, reference will be made herein to the accompanying drawing which shows a continuous fabric being treated in accordance with the teachings of the present invention.

In general, the process in accordance with the invention for the production of a textile reinforcing web for composite materials based on a warp-and-weft fabric is characterised in that:

- the base fabric consists of continuous filament yarns selected from glass yarns, aramid yarns, carbon yarns;
- at least one face of the said fabric is subjected to an abrasive surface treatment causing the rupture of a minor proportion of the filaments making up the said fabric, so as to form a plushy surface making it possible, when the web is incorporated within a resin, to have very good bonding characteristics with the resin and to obtain a laminated (planar or shaped) plaque exhibiting a surface quality which is practically free from any fault.

To make use of the process according to the invention it is possible to employ surface treatments which are known per se in the textile industry, especially in the field of apparel, in order to modify the surface appearance of the fabrics.

Thus, in order to produce fabrics of the "jeans" type, it has been proposed to perform abrasive surface treatments, as follows from FR-A-2,525,644 and FR-A2,335,636.

It has also been proposed, as follows from FR-A-2,555,405, to produce fabrics exhibiting a velvet appearance in ribbed form, or having a woolly appearance, by spraying abrasive particles, as follows from FR-A2,555,405 and EP-A-291,026.

Apart from the possibility of obtaining a fibrous appearance, it has also been proposed to employ such abrasive treatments to solve the problem of the pilling resistance of textile articles, as follows from FR-A2,145,263, the abrasive surface treatment then having the function of reducing the strength of the fibres so that they can break easily and separate from the surface of the said textile without forming fibrous pills.

It was completely unexpected that the fact of applying such abrasive surface treatments which lead to quite different results depending on the base textile structure treated, made it possible, in the case where such a treatment was applied to a reinforcing fabric for composite materials and more particularly to a fabric based on glass filaments (or the like), to obtain not only a rupture of the fibres making up the said fabric, resulting in the production of "surface plushes", but that such a treatment should also make it possible to improve the textile/resin bond without deteriorating the mechanical characteristics of the reinforcing textile and, above all, should lead to a laminated (planar or shaped) plaque exhibiting a surface quality which is practically free from any nonuniformity, thus making it possible to avoid a subsequent finishing treatment, such as a surface rubbing-down operation.

Furthermore, while the treatment in accordance with the invention is preferably carried out on only one of the faces of the fabric, it is obvious that it could also be envisaged to carry them out on both faces but, in such a case, while the textile/resin bond is improved, the mechanical characteristics of the reinforcing textile are, on the other hand, impaired.

By way of guidance and illustration, a unidirectional fabric weighing 400 grams/square meter, based on continuous glass yarns, having the characteristic of presenting most of these yarns in the warp direction (95%), bound together by a minor proportion of wefts (5% of the total weight of the fabric) was treated in accordance with the process according to the invention.

The warp yarns consist of roving strands with a count of 600 tex, while the weft yarns are thinner yarns with a count of 156 tex.

Such a fabric is treated in accordance with the invention by running between two rotary rolls 13 and 14, one of which roll 13, has an emery-coated surface. The running speed of the fabric within the two rolls is controlled at 10 m/min and the speed of rotation of the rolls is, for its part, controlled at 50 m/min, in the direction of forward movement of the fabric to be treated.

After the treatment a material which has a plushy surface is obtained and which, when incorporated within a resin 17 which is contained within a vessel 18, to produce a composite material, exhibits very good bonding characteristics with the said resin. The fabric is guided through the resin bath by means of guide rollers 16—16 and is stored upon a driven take up roll 20. Furthermore, the laminated plaque comprising such a material exhibits a perfect surface quality, free from any nonuniformity, and does not require any refinishing.

The process according to the invention can be applied to any type of woven textile structure employed in the field of reinforcement of composite material, not only when based on glass yarns as in the above example, but also when based on other fibres employed in this field, such as aramid- fibres, carbon fibres etc.

Such a surface treatment may, of course, also be carried out on mixed fabrics comprising an alternation of glass yarns coupled with yarns of other types such as, for example, high mechanical performance yarns, aramid, carbon etc.

I claim:

1. A process for the production of a textile reinforcing web for composite materials based on a warp and weft fabric that includes the steps of:

providing a base fabric of continuous filament yarn, said filament yarn being selected from a group of filaments consisting of glass yarn, aramid yarn, and carbon yarn, subjecting at least one face of the base fabric to an abrasive means for rupturing at least a portion of the filaments making up said base fabric to create a plush finish on said face, and imbedding said base fabric in a resin to obtain a laminated plaque exhibiting a substantially uniform finished surface quality whereby the base fabric requires no further finishing.

2. The process of claim 1 wherein the base fabric is passed through a pair of coating rolls, one roll of which includes abrading means for rupturing at least a portion of the filaments on one face of the base fabric.

3. The process of claim 2 that further includes the steps of maintaining the speed of the rolls at about five times the speed at which the base fabric is passed through said pair of rolls.

4. The process of claim 3 wherein about 95% of the base yarn is in the warp direction and about five percent of the yarn is in the weft direction and the further step of aligning the warp of the base fabric with the direction of travel of said fabric.

5. A textile reinforcing web for composite materials which includes:

a basic woven warp and weft fabric woven from continuous filaments selected from the group of filaments consisting of glass yarn, aramid yarn and carbon yarns;

at least one face of said fabric having sections of said continuous filaments ruptured to form a plush surface at said face;

a quantity of resin impregnated in said fabric and bonded with said ruptured filaments to form a laminated plaque exhibiting a substantially uniform finished surface quality whereby the fabric requires no further finishing.

6. The textile web of claim 5 wherein said basic fabric is unidirectional with a majority of the filaments extending in the warp direction and said ruptured filaments extending in the warp direction.

* * * * *